United States Patent [19]

Chang et al.

[11] 4,421,313

[45] Dec. 20, 1983

[54] DISPLAY SYSTEM HAVING MULTIPLE VIEWING STATIONS

[75] Inventors: Richard S. Chang, Rolling Hills Estates; Jan B. Chodak, Rancho Palos Verdes, both of Calif.

[73] Assignee: Mattel, Inc., Los Angeles, Calif.

[21] Appl. No.: 331,118

[22] Filed: Dec. 15, 1981

[51] Int. Cl.[3] ..... A63F 9/00

[52] U.S. Cl. ..... 273/237

[58] Field of Search ..... 273/1 E, 1 R, 1 ES, 273/236, 237, 85 GR; 40/430, 431, 442; 340/755; 358/87, 88, 241, 247, 252, 253; 434/43

[56] References Cited

U.S. PATENT DOCUMENTS

| | | | |
|---|---|---|---|
| 2,819,459 | 1/1958 | Dodd | 358/252 |
| 3,001,015 | 9/1961 | Weiss | 358/252 |
| 3,109,063 | 10/1963 | Parker | 358/352 |
| 3,777,059 | 12/1973 | Wilkey, Jr. | 340/717 |
| 3,976,837 | 8/1976 | Lang | 358/87 |
| 4,311,999 | 1/1982 | Upton et al. | 340/755 |
| 4,363,489 | 12/1982 | Chodak et al. | 273/237 |

*Primary Examiner*—Vance Y. Hum
*Assistant Examiner*—Leo P. Picard
*Attorney, Agent, or Firm*—Reagin & King

[57] ABSTRACT

An electro-mechanical display system is disclosed having four viewing stations. The system includes a rotating mirror and alphanumeric character generators, and is capable of simultaneously displaying different information to each of the viewing stations. The information displayed at each station is not observable at the other stations. Only one single-digit character-generator is required to display a line of information to two viewing stations.

12 Claims, 7 Drawing Figures

Fig. 2.
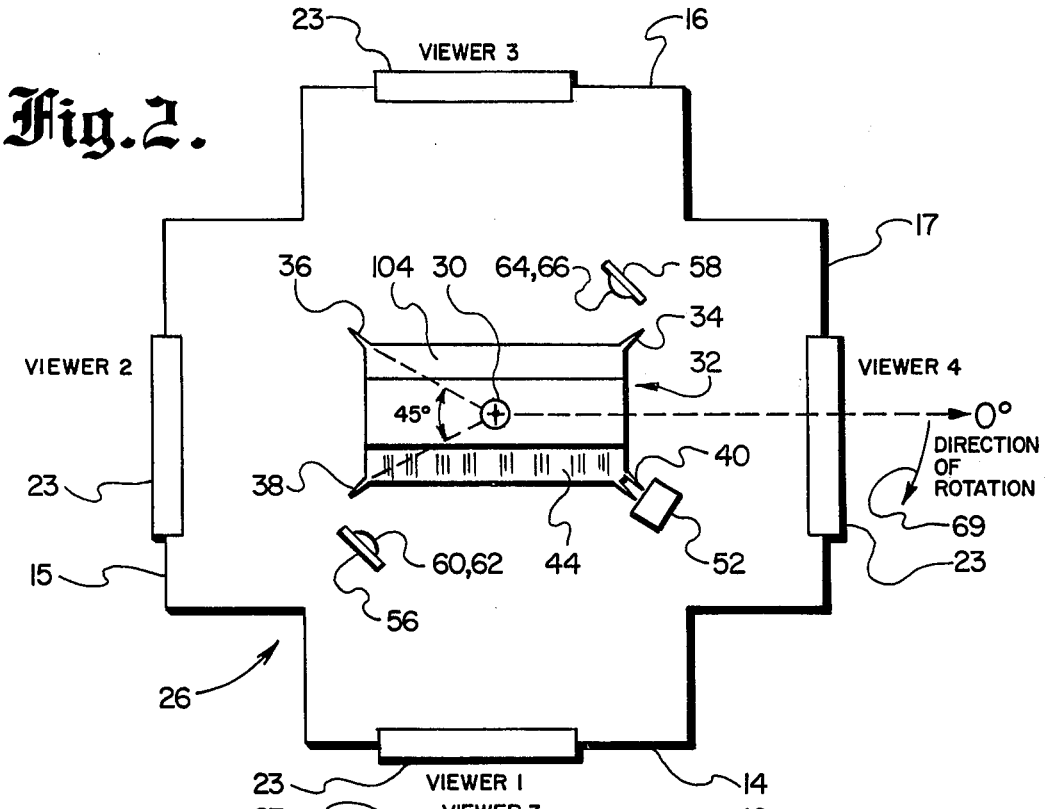
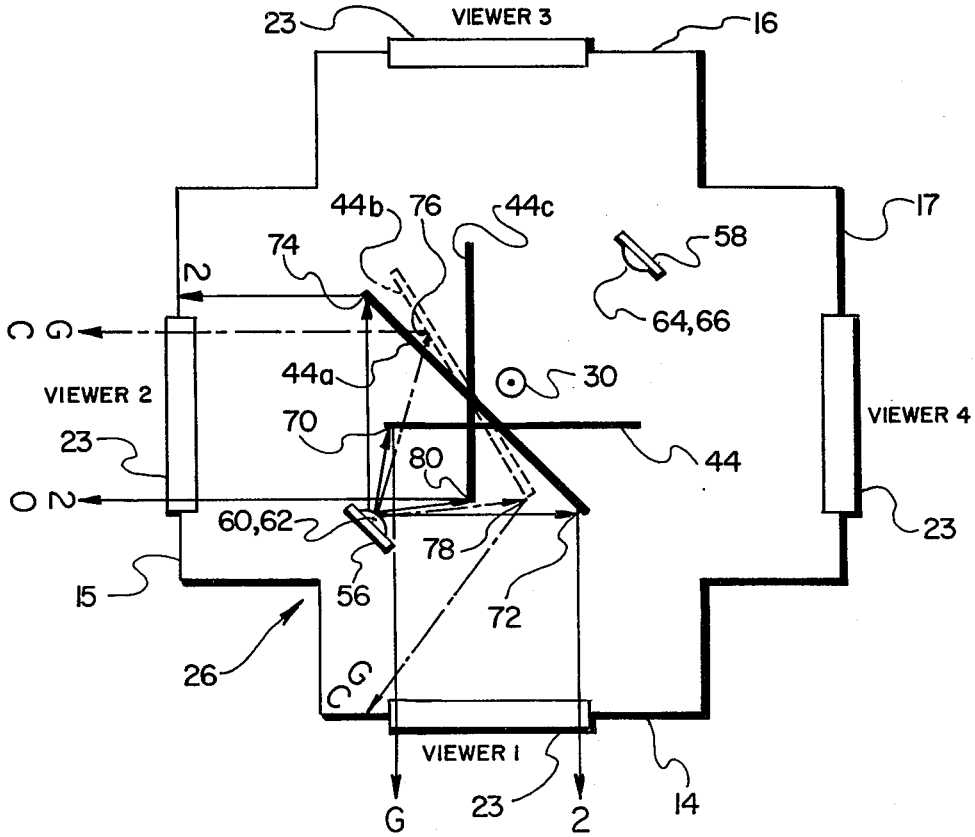
Fig. 3.

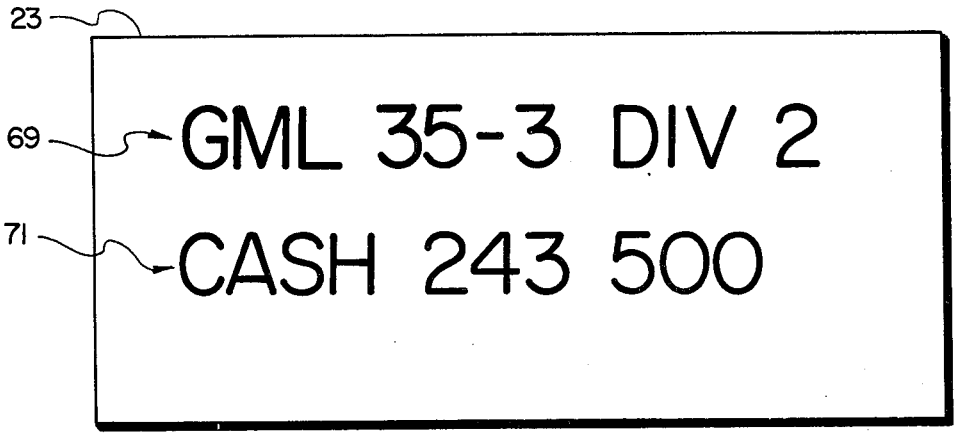
Fig. 4.
Fig. 6.
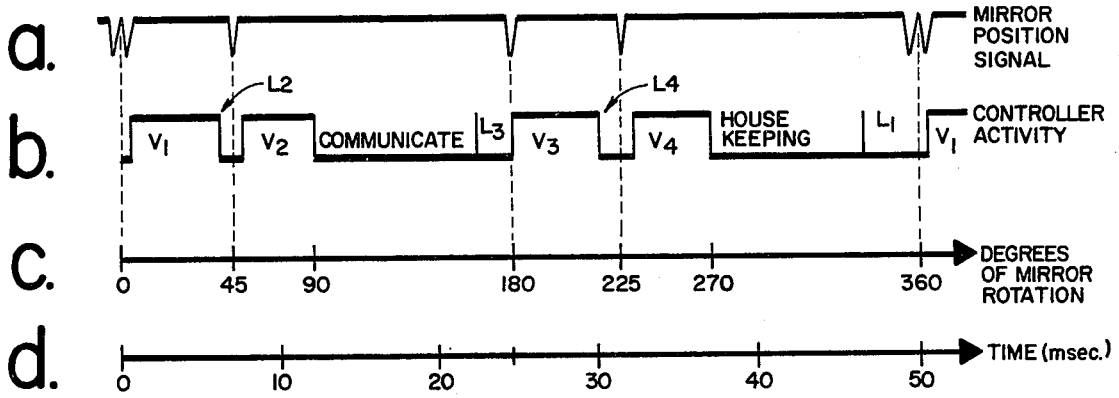
Fig. 7.
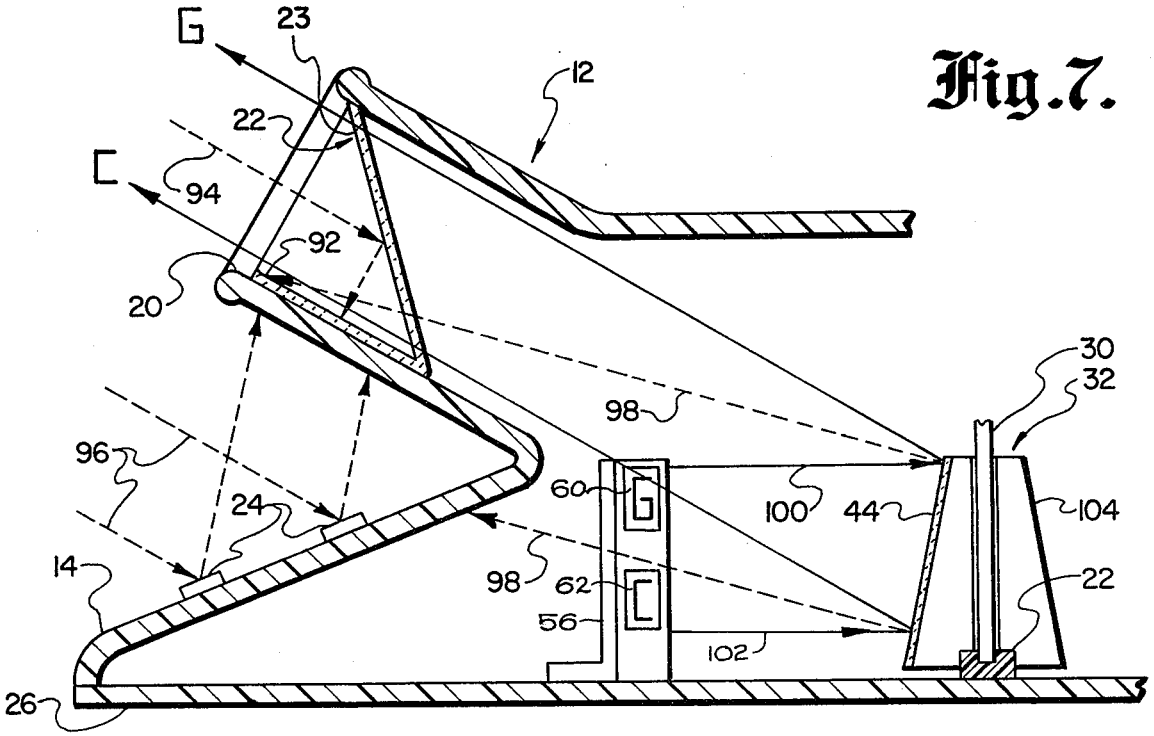

DISPLAY SYSTEM HAVING MULTIPLE VIEWING STATIONS

BACKGROUND OF THE INVENTION

This invention relates to displays and more particularly to electro-mechanical displays having multiple viewing stations. This invention is an improvement on the invention of U.S. patent application Ser. No. 167,569, filed July 11, 1980, entitled Display For Electronic Games And The Like, and assigned to the assignee of this invention.

In the field of electronic data processing there are many applications which require the display of information to a viewer. The simplest and least expensive of these displays uses lights, light emitting diodes, or liquid crystal structures in a matrix pattern to generate each display. Cathode-ray tubes are also utilized when a more sophisticated display is required. In those applications which require the display of separate information to more than one viewer, the displays described above must be duplicated for each viewing station, resulting in a large and expensive display system.

Applications requiring multiple viewing stations include computer output terminals, radar display stations, and sophisticated electronic games. Such an electronic game is disclosed in U.S. patent application Ser. No. 197,882, filed Oct. 17, 1980, entitled Stock Market Game and assigned to the assignee of the present invention. The operation of this game requires four independent viewing stations, each capable of simultaneously displaying different information to a responsive one of four players. An additional requirement is that the information being displayed at each station must not be observable by the players at the other stations.

Accordingly, it is an object of the present invention to provide a new and improved display system having multiple viewing stations.

It is another object of this invention to provide a display system having multiple viewing stations, each capable of simultaneously displaying different information.

It is another object of this invention to provide a display system having multiple viewing stations where the information displayed at each station is not observable at the other stations.

It is still another object of this invention to provide a display system having multiple viewing stations and requiring only a single character-generator to display information at two viewing stations.

SUMMARY OF THE INVENTION

The foregoing and other objects of the invention are accomplished by an electro-mechanical display system having four independent viewing stations. In the preferred embodiment, four alphanumeric character-generators are used in conjunction with a rotating mirror to display simultaneously two lines of information at each of the viewing stations. A controller monitors the angular position of the rotating mirror and selectively energizes the character-generators as a function of the mirror position. This arrangement permits different information to be simultaneously displayed at each viewing station and also ensures that the information at each station is not observable at the other stations. The controller may also be programmed to provide scrolling of the lines of information across the display at each station. This scrolling feature permits the continuous updating of information at each viewing station.

The physical placement of the mirror and the character-generators, and the construction of the display housing, are designed so that unwanted ambient light reflections do not interfere with the viewing of the information at each station.

Other objects, features, and advantages of the invention will become apparent by reference to the specification taken in conjunction with the drawings in which like elements are referred to by like reference designations throughout the several views.

BRIEF DESCRIPTION OF THE DRAWINGS

FIG. 2 is a top plan view of the inside of the display system of the present invention;

FIG. 3 is a diagram illustrating the operation of the display system as a function of the rotation of the mirror employed in the display system;

FIG. 4 is a diagram illustrating an example of the information which may be displayed by the display system of the present invention;

FIG. 6 is a series of graphs illustrating the relationship between the rotation of the mirror and the operation of the control circuitry of the present invention; and FIG. 7 is a partial cross-sectional view of the assembled display system showing the effects of ambient light reflections on the display system of the present invention.

DESCRIPTION OF THE PREFERRED EMBODIMENT

Figure 1:
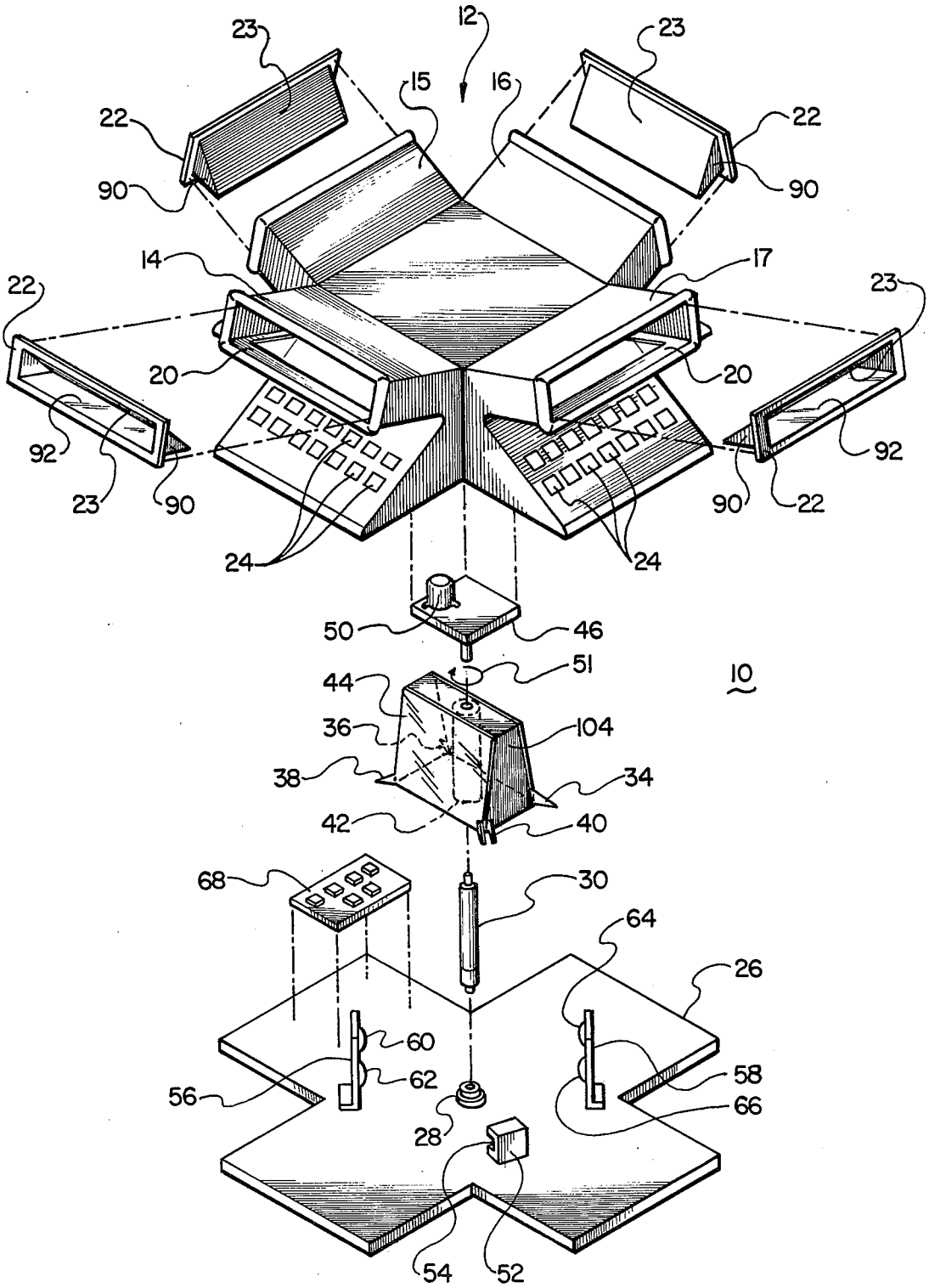
FIG. 1 is a perspective exploded view of the display system of the present invention.

Referring now to the drawings and more particularly to FIG. 1, there is shown an exploded perspective view of the display system 10 of the present invention. The display system 10 includes a housing 12 formed of an opaque material and having four sides 14–17 each of which is designated as a viewing station for a first, second, third, and fourth viewer, respectively. Each of the viewing stations 14–17 is provided with an opening 20 through which is mounted a light filter 22 having a viewing window 23. The viewing axes of the openings 20 and the windows 23 are each perpendicular to their respective stations 14–17 and each of the stations 14–17 is perpendicular to the adjacent station. As described below, each of the four viewers looks through his respective viewing window 23 into the interior of the housing 12 to see his particular display. Each of the viewing stations 14–17 is also provided with a set of keys 24 by means of which the viewer may enter data to alter the information being displayed by the display system 10.

As shown in FIG. 1, a base 26 forms the bottom surface of the housing 12. A bearing 28 is centrally mounted to the base 26 and forms the lower support for a vertical shaft 30. Coaxially mounted to the shaft 30 is an elongated, trapezoidal-shaped, mirror support 32. The mirror support 32 has rectangular-shaped sides and a hollow interior, and may be formed of any lightweight material such as a moldable plastic. Radially projecting outward from three of the four corners of the base of the support 32, are finger shaped projections 34, 36, and 38. Radially projecting outward from the fourth corner is a dual fingered projection 40. A hollow sleeve 42 is also provided along the vertical axis of, and within, the support 32. The sleeve 42 is used to mount the support 32 onto the shaft 30. On one of the rectangular sides of the support 32 there is provided a highly reflective surface forming a mirror 44. The highly reflective surface may be formed of a material such as metallized plastic to form the mirror 44. The shaft 30 passes through and is affixed to the cylinder 42 and is rotatably coupled at its upper end to the output of a gear train 46. The gear train 46 includes a DC motor 50 and is mounted to the housing 12 by suitable means such as brackets.

In the operation of the display system 10, energizing the DC motor 50 causes rotation of the shaft 30, the support 32 and, hence, the mirror 44 around a vertical axis and in the direction shown by the arrow 51 in FIG. 1. Affixed to the base 26 is a position sensor 52 which, in the preferred embodiment, is in the form of a photo interrupter well known to those skilled in the art. The sensor 52, used to determine the angular position of the mirror 44, includes a slot 54. Mounted to one side of the slot 54 is a light source such as a light emitting diode. Mounted to the opposing side of the slot 54 is a photodetector such as a phototransistor. The light source projects a beam of light across the slot 54, which light is detected by the phototransistor. When an object passes through the slot 54, it interrupts the light beam and causes an electrical output signal from the phototransistor. As described below, the sensor 52 is positioned on the base 26 so that when the mirror support 32 is rotating about the shaft 30, the fingers 34, 36, 38, and 40 sequentially pass through the slot 54 of the sensor 52. This configuration provides means for determining the angular position of the mirror 44.

Also mounted to the base 26 are displays 56 and 58. The displays 56 and 58 each contain two character-generators 60 and 62, 64 and 66, respectively. Each of the character-generators 60, 62, 64, and 66 is in the form of a single-digit 14-segment alphanumeric light emitting diode display well known to those skilled in the art. Such displays are commonly used in calculators and in other electronic equipment as part of an array to display legends and numerical results. Each of the single-digit character-generators 60, 62, 64 and 66 is mounted in a vertical plane parallel to the axis of the shaft 30 and is oriented with its viewing axis facing the center of the base 26. The character generators 60 and 64 are positioned, respectively, above the character generators 62 and 66. As described below, the displays 56 and 58 are each used to provide two lines of information for two of the four viewing stations 14–17 of the display system 10. The various power supplies and control electronics for operating the display system 10 are mounted on a printed circuit board 68 which is in turn fastened to the base 26.

Referring now to FIG. 2, there is shown a top view of the interior of the display system 10 illustrating the relative positions of the various components. The support 32 is shown in the position where the mirror 44 is parallel to the viewing station 14. This position of the mirror 44 is defined as the reference, or zero degree, position for measuring the angular rotation of the mirror 44. As shown in FIG. 2, in this reference position the dual fingers 40 of the support 32 are located within the slot 54 of the position sensor 52. As described below, the dual fingers 40 produce an output signal from the sensor 52 in the form of a double pulse. This double pulse provides an indication to the control electronics of the display system 10 that the mirror 44 is parallel to the viewing station 14. The display 56 is positioned between the viewing stations 14 and 15 so that the axis of each of the character-generators 60 and 62 describes a forty-five degree angle with respect to the axes of the windows 23 of the stations 14 and 15. Similarly, the display 58 is positioned between the viewing stations 16 and 17 so that the axis of each of the character generators 64 and 66 describe a forty-five degree angle with respect to the axes of the windows 23 of the stations 16 and 17.

As the mirror 44 rotates about the shaft 30 in the direction shown by the arrows 69 in FIG. 2, the fingers 34, 36, and 38 each pass through the position sensor 52 in sequence. The length and width dimensions of the support 32 are chosen so that the angle between the fingers 34 and 40 represents forty-five degrees of rotation of mirror 44. In like manner, the angle between fingers 36 and 38 also represents forty-five degrees of rotation of the mirror 44. Accordingly, as the mirror 44 makes a complete revolution, the dual fingers 40 pass the sensor 52 at the zero degree reference point, the finger 34 passes through the sensor 52 at forty-five degrees of rotation, the finger 36 passes through the sensor 52 at one hundred eighty degrees of rotation, the finger 38 passes through the sensor 52 at two hundred twenty-five degrees of rotation, and finally the dual fingers 40 again pass through the sensor 52 after three hundred and sixty degrees or one full revolution of the mirror 44. The output of the sensor 52, representing the angular position of the mirror 44, is used by the control electronics within the display system 10 to control the information displayed by the character-generators 60, 62, 64 and 66 to provide the desired information at each of the viewing stations 14–17. The viewing axis of the mirror 44 is perpendicular to the plane of the mirror 44.

Referring to FIG. 3, there is shown a top view of the inside of the display system 10 illustrating the paths of light from the character-generators 60 and 62 of display 56 as a function of the rotation of the mirror 44. For purposes of example, it is assumed that two lines of information 69 and 71, as shown in FIG. 4, are to be displayed so that the top line 69 can be viewed by both viewer one and viewer two at the viewing stations 14 and 15, respectively; and so that the bottom line 71 can be viewed only by viewed two at viewing station 15. The example shown in FIG. 4 is typical of the information that is displayed to players operating the Stock Market Game as explained in application Ser. No. 197,882 referred to above.

Returning to FIG. 3, the mirror 44 is shown in a first position parallel to the viewing station 14, and thus at the zero degree or reference point of rotation. At this position of the mirror 44, the control electronics within the display system 10 illuminates the proper segments of the top character-generator 60 of the display 56 to form the letter "G". The letter "G" is reflected from the mirror 44 at a location 70 and is seen by viewer one at the left-hand side of the viewing window 23 of the viewing station 14. The "G" represents the first letter in the top line 69 of FIG. 4. As shown in FIG. 1, the character-generator 60 is positioned directly above the character-generator 62. The character-generator 60 thus provides the top line 69 and the character generator 62 provides the bottom line 71 shown in FIG. 4. Since it is desired that only the top line 69 can be displayed to viewer one, the bottom character-generator 62 is not energized at this time.

As the mirror 44 rotates about the shaft 30, the character-generator 60 is illuminated to display sequentially each of the letters in the top line 69. The period of illumination should not exceed approximately 1 degree of rotation, or unacceptable character smear may result. The rotation of the mirror 44 causes each of these letters to be presented in sequence from left to right across the viewing window 23 of the viewing station 14. When the mirror 44 approaches a position of approximately forty-five degrees of rotation, shown as 44(*a*) in FIG. 3, the character-generator 60 is operated to form the last character "2" in the top line 69. Each of the characters between the "G" and the "2" are sequentially displayed by synchronizing the illumination of the character-generator 60 with the rotation of the mirror 44 as described below. The last character "2" is reflected from the mirror position 44(*a*) at a location 72 and is seen by viewer one at the right extreme of the viewing window 23 of the viewing station 14. Thus, with a single character-generator 60, an entire line of information may be presented at the viewing station 14. FIG. 3 also shows that the character "2" is reflected from the upper end of the mirror position 44(*a*) at a location 74. However, this reflection of the character "2" falls outside of the viewing window 23 of the viewing station 15 and cannot be observed by viewer two.

As the mirror rotates from the position 44(*a*) to position 44(*b*), which is somewhat greater than forty-five degrees, the control electronics within the display 10 begins displaying the information to be viewed by viewer two at the viewing station 15. Since both the first and second lines 69 and 71 are to be displayed to viewer two, character-generators 60 and 62 are energized to form the first letters "G" and "C", respectively, although not necessarily at the same time. These letters "G" and "C" are reflected from location 76 of the mirror position 44(*b*) and appear at the left side of the viewing window 23 of the viewing station 15. These same letters are also reflected from the bottom of the mirror position 44(*b*) at location 78, but this reflection is outside of the viewing window 23 of viewing station 14. Thus, viewer one cannot see the information being displayed to viewer two. As the mirror rotates from the position 44(*b*) to a ninety degree position 44(*c*), each of the letters in the top line 69 and the bottom line 71 of FIG. 4 is sequentially displayed by the character-generators 60 and 62, in the manner described above, and appear as entire lines of information to viewer two. When the mirror is in the ninety degree position 44(*c*) the last characters "2" and "0" of the lines 69 and 71, respectively, are reflected from the mirror position 44(*c*) at location 80 and appear at the right side of the viewing window 23 of the viewing station 15. From the foregoing discussion, it can be seen that separate and independent lines of information 69 and 71 can be selectively displayed at two viewing stations 14 and 15 while using only two single-digit character-generators, 60 and 62.

The mirror 44 is rotated by the motor 50 and the gear train 46 at a nominal speed of twelve hundred revolutions per minute. When a fixed line of information is to be displayed, this information is repeated for each revolution and at the same angular positions of the mirror 44. In the preferred embodiment, the speed of rotation of the mirror 44 has been chosen to correspond to a display rate of approximately twenty frames per second. In a manner analogous to the operation of motion picture and television cameras, the persistence of the human eye is sufficient at this frame speed to perceive the display as stationary and continuous.

There are several ways to update the information to be displayed in the display system 10 of the present invention. One way is to change completely the information to be displayed on a regular basis; for example, every five seconds. An alternate way of updating the information is by means of scrolling. In scrolling, the characters appear to move from right to left across the viewing window 23 with old information disappearing from the screen on the left side and new information appearing on the screen from the right side. In the display system 10, scrolling is easily accomplished in the following manner. Using the top lines 69 of FIG. 4 as an example, after displaying the line 69 for a fixed time interval, the control electronics within the display 10 is programmed to shift all the characters of the line 69 one position to the left. For example, the first character to appear initially in the line 69 is "G"; five seconds later the first character is "M" and the entire line 69 is shifted one character to the left with new information beginning to appear on the right. Because of the persistence of the human eye, and assuming the character shift is performed on a regular basis, the line 69 will appear to move or scroll across the screen from right to left. This scrolling scheme for updating information is used in the play of the Stock Market Game as explained in application Ser. No. 197,882 referred to above.

Returning to FIG. 3, the means for providing information to the viewing stations 16 and 17 for viewers three and four is described as follows. When the mirror 44 rotates to the one hundred eighty degree position, the mirror 44 is parallel to the viewing station 16. Referring to FIG. 2, this position of the mirror 44 coincides with the finger projection 36 moving through the sensor 52. At this point of rotation, the control electronics within the display system 10 activates the character-generators 64 and 66 of the display 58 to provide the desired information to viewer three at viewing station 16. The subsequent operation of the display 10 for viewers three and four is identical to the operation described above for viewers one and two. Thus, as the mirror moves from the one hundred eighty degree position to the two hundred twenty-five degree position, viewer three sees the information displayed across the viewing window 23 at station 16 by the character-generators 64 and 66. As the mirror moves from the two hundred twenty-five degree to the two hundred seventy degree point, the appropriate information is displayed to viewer four at viewing station 17 by the character-generators 64 and 66.

If, for example, the same information displayed above to viewers one and two at stations 14 and 15 is to be displayed to viewers three and four, respectively, the operation of the character-generators 64 and 66 is identical to the operation of the character-generators 60 and 62. From the above discussion, it can be seen that only two displays 56 and 58 are required to display simultaneously different information at the four independent viewing stations 14–17.

While two character-generators are shown for the displays 56 and 58, it is obvious from the above discussion that only a single character-generator is needed at each of the displays 56 and 58 to create a single line of information. Alternatively, more than two character-generators can be provided at each of the displays 56 and 58 to create more than two simultaneous lines of information at each of the viewing stations 14–17.

Figure 5:
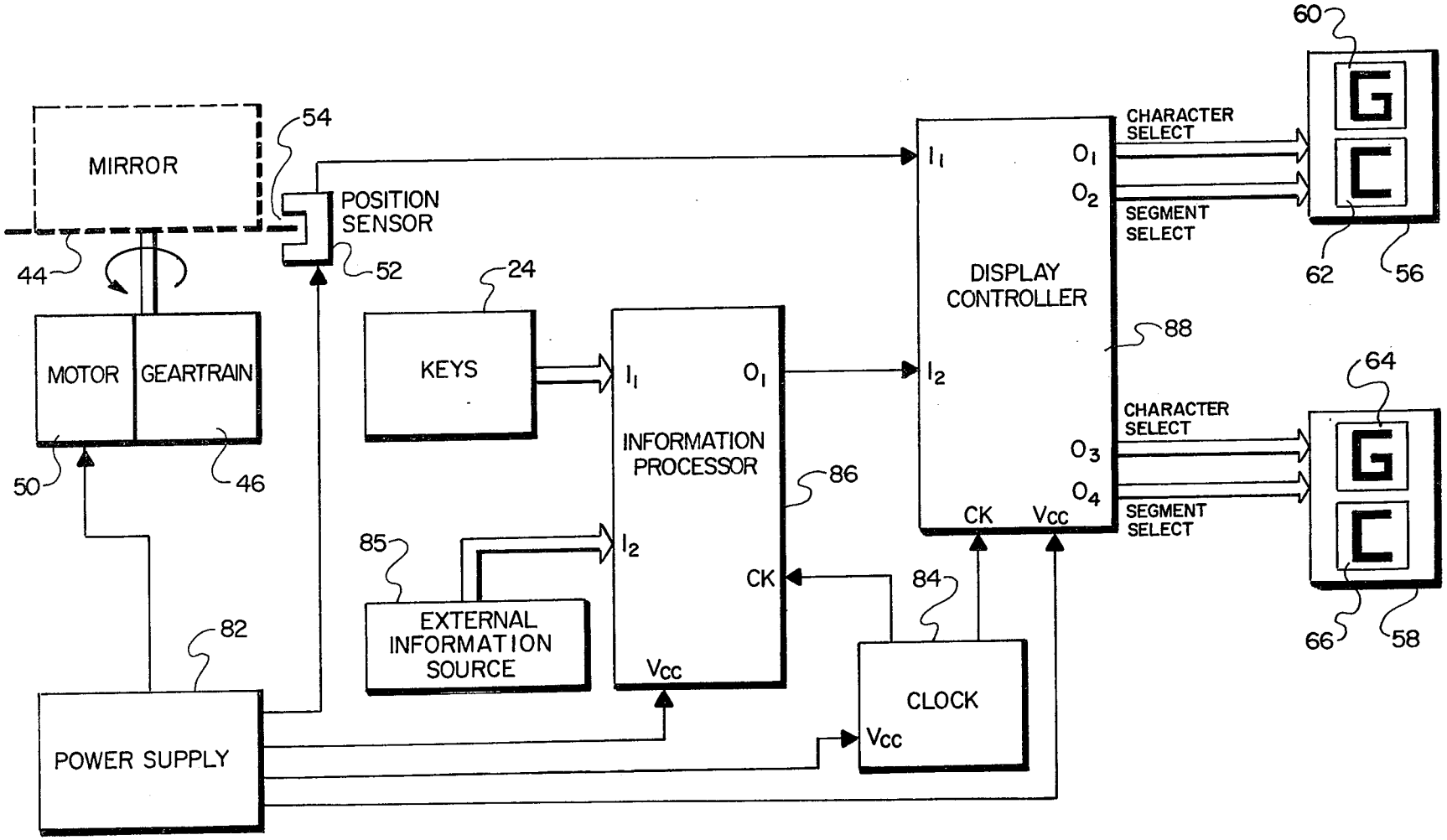
FIG. 5 is a block diagram illustrating the control circuitry of the display system of the present invention.

FIG. 5 is a block diagram illustrating the control circuitry which may be utilized in the preferred embodiment of the invention. The arrangement shown in FIG. 5 includes a power supply 82 which provides power to operate the motor 50, a clock circuit 84, control circuits 86 and 88 and the position sensor 52. The control circuit 86 serves as an information processor which receives information from a variety of sources, processes the information in a predetermined program, and outputs the information to be displayed to the control circuit 88, which serves the function of a display controller. As shown in FIG. 5, the keys 24 of the various keyboards at each of the viewing stations 14–17 are connected to input terminals $I_1$ of the circuit 86, and an external information source 85 is shown connected to input terminal $I_2$ of the circuit 86. The external information source 85 may represent a computer output or any other electronic apparatus where it is desired that the output be displayed to a viewer. Timing signals are provided at terminals CK of the control circuits 86 and 88 from the clock circuit 84. Output terminal $O_1$ of the circuit 86 is connected to the input terminal $I_2$ of the display controller 88, and the output of the position sensor 52 is connected to input terminal $I_1$ of display controller 88.

The purpose of display controller 88 is to arrange the information to be displayed into the proper sequence of characters to be illuminated by the character-generators 60, 62, 64 and 66. As shown in FIG. 5, signals from output terminals $O_1$ and $O_3$ of the controller 88 are used to select the appropriate character-generators of the displays 56 and 58, and signals from output terminals $O_2$ and $O_4$ are used to select the proper segments of each of the fourteen-segment alphanumeric character-generators 60, 62, 64 and 66 to form the desired character.

As will be understood by those skilled in the art, the control circuits 86 and 88 may be implemented in any of a number of different ways. However, as with many prior art electronic control systems, the preferred embodiment of the invention utilizes integrated-circuit microprocessors. Such integrated circuit microprocessors are well known and include all of the input, output, memory, logic and control circuitry of a special purpose digital computer in miniature form. In general, such circuits have both random access memory (RAM memory) and read only memory (ROM memory). The ROM memory has connections formed by masking operations during the construction of the basic circuitry to provide a completely wired circuit which includes the program controlling the operation of the microprocessors. The RAM memory of the processor is utilized for storage of the various bits of information utilized during the operation of the circuit.

Various control circuits are offered by a number of manufacturers and are well known to the prior art. The preferred embodiment of the present invention uses two HMC-45 microprocessors manufactured by Hitachi, Ltd. The circuit for such a microprocessor is better described in the "Programmers Reference Manual For HMCS 40 Series Four-Bit Single-Chip Microcomputers" published by Hitachi, Ltd., Tokyo, Japan.

In the particular embodiment shown in FIG. 5, the display controller 88 receives the information to be displayed at two of the four viewing stations 14–17 of the display system 10 from the information processor 86. The controller 88 stores the information to be displayed at the first viewing station 14 in the output buffers of the controller 88. When the outpt signal from the position sensor 52 indicates that the mirror 44 is in the proper position, the controller 88 provides the information to the proper characters and segments of the display 56 in the manner described above to create the information to be viewed by viewer one. When the output of information for viewer one at viewing station 14 is completed, the controller 88 transfers to its output buffers the information to be displayed to viewer two at viewing station 15. When the output of the position sensor 52 indicates the appropriate position of the mirror 44, the controller 88 provides the information in the proper format to the display 56 to generate the information for viewer two.

The operation of the controller 88 may be shown by the graphic illustrations of FIG. 6. Curve C of FIG. 6 represents the angular degrees of rotation of the mirror 44, starting from the reference position shown as zero degrees in FIG. 2. Curve A in FIG. 6 shows the output signal of the position sensor 52 as a function of the rotation of the mirror 44. Curve B of FIG. 6 shows the activity of the controller 88 in relation to the output signal of the position sensor 52 and the angular rotation of the mirror 44. Curve D of FIG. 6 provides a time reference for the operation of the display system 10.

Referring now to curve A of FIG. 6, it can be seen that the output signal of the sensor 52 comprises a pulse each time one of the projections 34, 36, 38 and 40 of the mirror support 32 passes through the slot 54 in the sensor 52. At the reference point of zero degrees of the mirror rotation, a double pulse is created at the output of the sensor 52 in response to the dual projections 40 as shown in FIG. 2. This double pulse signifies to the controller 88 that the mirror 44 is at the reference position representing the beginning of the display to viewer one at the viewing station 14. As shown in curve A of FIG. 6, a single pulse occurs at the output of the sensor 52 when the mirror has rotated to the forty-five degree position, represented by the projection 34 passing through the sensor 52. In like manner, pulses are generated at the one hundred eighty degree rotation point and at the two hundred twenty-five degree rotation point of the mirror 44 in response to the projections 36 and 38 passing through the sensor 52. At the end of one full rotation, the projections 40 again produce a double pulse. The time interval between successive pulses is used by the controller 88 to synchronize the display output signals with the position of the rotating mirror 44.

Referring now to curve B of FIG. 6, after the double pulse occurs at the output terminal of the sensor 52, the controller 88 provides the information to be displayed to viewer one at station 14. This activity is indicated by the area $V_1$ in curve B. The information is displayed as described above over the interval of rotation of the mirror 44 from just past zero degrees to a point just before the mirror 44 achieves forty-five degrees of rotation. The controller 88 sequentially provides each character in a line of information at a rate which is calculated to complete the entire line within the prescribed angular rotation of the mirror 44. This rate is calculated based on the speed of the mirror 44 and the maximum number of characters in a line. When the information to be displayed to viewer one is complete, the controller 88 transfers the information to be displayed to viewer two into its output buffers. This activity is designated as $L_2$ in curve B. After receiving the output signal from sensor 52 indicating the mirror 44 is at the forty-five degree point, the controller 88 provides the information to viewer two at viewing station 15. This activity is shown as $V_2$ in curve B. It should be noted that the loading of the information for viewer two occurs just prior to the forty-five degree rotation point of the mirror 44. Thus, no information is displayed at the forty-five degree rotation point. This ensures that none of the information displayed to viewers one and two overlap, precluding the possibility of either of these viewers viewing the information designated for the other viewer. In addition, an adjustable delay is provided just after the forty-five degree rotation point to enable the letters to appear to scroll across the screen. The point at which the information to be displayed to viewer two is provided by the controller 88 is shown as the position 44(b) in FIG. 3.

As the mirror 44 rotates from the position 44(b) to the position 44(c) in FIG. 3, the controller 88 provides the information to viewer two. When this information is complete, which occurs just prior to the ninety degree rotation point of the mirror 44, no further information is provided until the mirror 44 reaches the one hundred eighty degree point, parallel to viewing station 16. During the time interval between ninety degrees and one hundred eighty degrees of rotation of the mirror 44, the information processor 86 transfers to the display controller 88 the necessary information to be supplied to viewers three and four at viewing stations 16 and 17. During this same time interval the controller 88 stores the information to be provided to viewer three in the output buffers of the controller 88. These events are shown by the areas labeled "communicate" and $L_3$ in curve B of FIG. 6. Thus, when the mirror 44 reaches the one hundred eighty degree point of rotation, the controller 88 is ready to display the information to viewing station 16. This activity is shown as $V_3$ in curve B of FIG. 6.

In a manner analagous to the display of information to viewers one and two, the controller 88 follows the same routine for viewers three and four. Thus, at a point just before two hundred twenty-five degrees of rotation of the mirror 44, the output of information to viewer three is completed and the controller 88 transfers the information for viewer four into its output buffers. This activity is illustrated as the area $L_4$ in curve B of FIG. 6. Just past the two hundred twenty-five degree point, the controller 88 provides the information to viewer four at viewing station 17. This activity is shown as $V_4$ in curve B. The information displayed to viewer four is completed by the two hundred seventy degree point of rotation, where the mirror 44 is parallel to the viewing station 17. No further information is provided until the mirror 44 returns to its reference position, completing one full rotation. Thus, during the time interval between the two hundred seventy degree and three hundred sixty degree rotation point of the mirror 44, the information processor 86 transfers the new information to be displayed to viewers one and two to the display controller 88, and the display controller 88 stores the new information to be viewed by viewer one in its output buffers. These events are shown as the areas labeled "housekeeping" and $L_1$ in curve B of FIG. 6. The cycle is then repeated for the next rotation of the mirror 44.

From the above discussion, it can be seen that the configuration of the rotating mirror 44 and the viewing stations 14–17 of the display system 10 creates time intervals during each rotation of the mirror 44 during which the control circuits 86 and 88 may perform the necessary communication and data shifting functions to operate properly the display system 10. This configuration minimizes the memory requirements of the control circuits 86 and 88. Thus the controller 88 need only store and control the information for two viewers at any one time, and the information processor 86 has sufficient time to perform any necessary calculations or other logic functions.

The display system 10 of the present invention is capable of providing the simultaneous display of information to four independent viewing stations. In addition, the display system 10 is provided with means for enhancing the readability of the information at each of the viewing stations 14–17 by minimizing ambient light reflections which interfere with the viewing of the information.

FIG. 7 is a cross-section of a typical viewing station, such as station 14, showing the effects of ambient light on the readability of the display. In FIG. 7, the light filter 22 is shown in place within the opening 20 of the housing 12. Referring to FIG. 1 it can be seen that the filter 22 is formed as a generally triangular-shaped cavity having ends 90, a bottom surface 92 and the viewing window 23. The ends 90 and the bottom surface 92 are formed to be opaque, and of a dark color to absorb reflected light. The viewing window 23 is tinted to impart a red color to light passing through it. The use of the red window for light emitting diode displays is well known to those skilled in the art. The red color acts as a filter to enhance the red LED display. The window acts to remove the scattered background light entering the cavity through double absorption without significantly changing the display intensity. As described above, the information displayed is in the form of a reflection from the mirror 44. The ends 90 and the bottom surface 92 form a shadow box to decrease the effects of ambient light as described below.

One source of unwanted ambient light is due to reflections from the face of the viewer as well as from overhead room light. In FIG. 7, dotted lines indicate rays of unwanted ambient light while solid lines indicate reflections of the information to be viewed by the viewer. Rays 94 represent typical reflections from the face of the viewer or from room ambient light. As shown in FIG. 7, the rays 94 are reflected from the viewing window 23 and are absorbed by the bottom surface 92 of the filter 22. The plane of the viewing window 23 is oriented downward from the vertical, causing the rays 94 to be deflected toward the bottom surface 92.

Another source of unwanted ambient light reflections is the viewers' fingers when they are in place on the keys 24 of the keyboard at each of the viewing stations 14–17. The housing 12 is designed so that the keyboard keys 24 are located beneath the opening 20. Thus, as shown in FIG. 7, ambient light rays 96 impinging on the keys 24 are reflected to portions of the housing 12 under the opening 20 and are absorbed by the housing 12. From the above discussion, it can be seen that ambient light reflections from sources external to the display system 10 are reflected and absorbed in a manner which prevents them from interfering with the viewing of the information of the display system 10.

Another source of unwanted light is due to reflections from components internal to the housing 12. Such reflections represent glare to the viewer when they are reflected along a line normal to the plane of the mirror 44. The rays 98 in FIG. 7 represent reflections normal to the plane of the mirror 44. It can be seen that these reflections 98 are absorbed either by the inside surface of the housing 12 or by the surface 92 and do not interfere with the viewing of the display 56 reflected by the mirror 44. It can also be seen that the mirror 44 is oriented in a plane which is tilted upward approximately twenty degrees from the vertical. At this angle, the light rays 100 and 102 emitted from the top and the bottom of the display 56 by the character-generators 60 and 62, respectively, are reflected out through viewing window 23 and can be clearly seen by the viewer at the viewing station 14.

In another embodiment of the display system 10, the mirror support 32 may be provided with two mirrored surfaces. Thus, in addition to the mirror 44 described above, the opposite side of the mirror support 32, shown as the side 104 in FIGS. 1, 2, and 7, is also provided with a mirrored surface. One advantage of having two mirrored surfaces on mirror support 32 is that the information displayed to the viewing stations 14–17 can be provided twice for every revolution of the mirror support 32. This is as opposed to providing information once in each revolution in the preferred embodiment. Providing information twice each revolution allows the mirror support 32 to be rotated at one half the speed while achieving the same frame rate of the preferred embodiment. Slowing the rotation of the mirror support 32 has the effect of reducing the power consumption of the motor 50. In apparatus operated by batteries, this can result in increased battery life.

One disadvantage of a system employing two mirrored surfaces is that the time intervals shown for communication in curve B of FIG. 6 are no longer available if the viewer information is provided twice each revolution. This means that both the information processor 86 and the display controller 88 require increased memory capacity and faster data transfer speeds both to enable and display controller 88 to store information for all four viewers at one time. Another disadvantage of using double mirrors is that precise alignment of both mirrors to the rotating axis is required to avoid blurring of the image.

It should also be noted that while the preferred embodiment shows the use of a plurality of finger projections 34, 36, 38, and 40, as part of the position sensing configuration for the mirror 44, it is also possible to employ only a single projection to sense the position of the mirror 44. In such a case, the display controller 88 is programmed to calculate the time interval between successive pulses caused by the single projection. This time information permits the display controller 88 to calculate the speed of rotation of the mirror 44 and hence to predict its angular position as a function of time. One disadvantage of this configuration is that it assumes that the speed of the mirror 44 is constant over a complete revolution of the mirror 44. By using multiple projections as in the preferred embodiment, the requirement for constant speed of the mirror 44 during any given rotation is greatly reduced, permitting the use of a less expensive motor 50 and gear train 46.

While the invention is thus disclosed and the presently preferred embodiment described in detail, it is not intended that the invention be limited to the shown embodiment. Instead many modifications will occur to those skilled in the art which lie within the spirit and scope of the invention. It is accordingly intended that the invention be limited only by the appended claims.

What is claimed is:

1. A display system of the type including player response devices and individual viewing stations for presenting information to be viewed at multiple viewing stations, comprising:

a housing having openings to form the viewing stations;

single character generator means mounted within the housing and used to generate characters which act to present information at any of the viewing stations;

a mirror mounted within the housing;

means for rotating the mirror about an axis to provide a reflective light path from the character generator means to the openings;

means located relative to said mirror rotating means for determining the position of the mirror; and means for preventing players at other viewing stations from receiving the information presented at a viewing station, including means responsive to the position of the mirror for activating the character generator at predetermined positions of the mirror which provide a reflective light path from the character generator means to the opening at a desired one of the viewing stations.

2. A display system for presenting information to be viewed at multiple viewing stations, comprising:

a housing having four sides and provided with an opening in each of two adjacent sides to form first and second viewing stations, where the viewing axis of each opening is normal to the viewing axis of the adjacent opening;

character generator means mounted within the housing;

a mirror mounted within the housing;

means for rotating the mirror about an axis to provide a reflective light path from the character generator means to the openings including means for rotatably mounting the mirror about a vertical axis at the center of the housing;

means for determining the position of the mirror; and means for preventing viewers at other viewing stations from observing the information presented at a viewing station, including means responsive to the position of the mirror for activating the character generator at predetermined positions of the mirror which provide a reflective light path from the character generator means to the opening at a desired one of the viewing stations, and where the character generator means includes a first character generator radially disposed at a corner of the housing between the adjacent openings which form the first and second viewing stations, with the plane of the first character generator being parallel to the axis of rotation of the mirror, and the viewing axis of the first character generator oriented at forty-five degrees to the respective viewing axes of the adjacent openings; and the means responsive to the position of the mirror further includes means for activating the first character generator when the viewing axis of the mirror is within forty-five degrees of the viewing axis of the first generator.

3. The display system of claim 2 in which the mirror is rotated in a direction which provides, sequentially, a reflective light path from the first character generator to the first viewing station and from the first character generator to the second viewing station; and the means for preventing viewers at other viewing stations from observing the information presented at a viewing station further includes presenting a first line of information to the first viewing station by activating the first character generator to display sequentially each of the characters of the first line as a function of the position of the mirror, the sequence beginning when the viewing axis of the mirror has rotated to within forty-five degrees of the viewing axis of the first generator and ending before the viewing axis of the mirror is parallel to the viewing axis of the first generator, and presenting a second line of information to the second viewing station by activating the first character generator to display sequentially each of the characters of the second line as a function of the position of the mirror, the sequence beginning when the mirror has rotated past the point at which the viewing axis of the mirror is parallel to the viewing axis of the first generator and ends before the viewing axis of the mirror has rotated more than forty-five degrees past the viewing axis of the first generator.

4. The display system of claim 3 in which the housing further includes an opening in each of the two remaining sides to form third and fourth adjacent viewing stations, the viewing axis of each of these openings being normal to the viewing axis of the adjacent opening; the character generator means includes a second character generator radially disposed at one corner of the housing between the adjacent openings which form the third and fourth viewing stations, the plane of the second character generator positioned parallel to the axis of rotation of the mirror, and the viewing axis of the second character generator oriented at forty-five degrees to the respective viewing axes of the adjacent openings; and the means for preventing viewers at other viewing stations from observing the information presented at a viewing station further includes activating the second character generator when the viewing axis of the mirror is within forty-five degrees of the viewing axis of the second generator.

5. The display system of claim 4 in which the mirror rotation further provides, sequentially, a reflective light path from the second character generator to the third viewing station and from the second character generator to the fourth viewing station; and the means for preventing a viewer at other viewing stations from observing the information presented at a viewing station further includes presenting a third line of information to the third viewing station by activating the third character generator to display sequentially each of the characters of the third line as a function of the position of the mirror, the sequence beginning when the viewing axis of the mirror has rotated to within forty-five degrees of the viewing axis of the second generator and ending before the viewing axis of the mirror is parallel to the viewing axis of the second generator, and presenting a fourth line of information to the fourth viewing station by activating the second character generator to display sequentially each of the characters of the fourth line as a function of the position of the mirror, the sequence beginning when the mirror has rotated past the point at which the viewing axis of the mirror is parallel to the viewing axis of the second generator and ends before the viewing axis of the mirror has rotated more than forty-five degrees past the viewing axis of the second generator.

6. A display system for presenting information to be viewed at multiple viewing stations, comprising:

a housing having openings to form the viewing stations;

character generator means mounted within the housing;

a mirror mounted within the housing;

means for rotating the mirror about an axis to provide a reflective light path from the character generator means to the openings;

means for determining the position of the mirror; including means for mounting the mirror to a mirror support having a generally rectangular base; projections radially disposed from the corners of the rectangular base; and sensing means for determining the presence of the projections at a predetermined position as the mirror rotates; and means for preventing viewers at other viewing stations from observing the information presented at a viewing station, including means responsive to the position of the mirror for activating the character generator at predetermined positions of the mirror which provide a reflective light path from the character generator means to the opening at a desired one of the viewing stations.

7. The display system of claim 6 in which the length and width of the rectangular base are selected so that the angle formed between two adjacent projections is forty-five degrees; and in which two projections are disposed from one corner of the base to indicate a reference position of the mirror to the sensing means.

8. The display system of claim 3 further including a third character generator positioned above the first character generator to enable the simultaneous presentation of two lines of information at the first and second viewing stations.

9. The display system of claim 5 further including a fourth character generator positioned above the second character generator to enable the simultaneous presentation of two lines of information at the third and fourth viewing stations.

10. The display system of claim 5 further including means for changing the information presented by periodically activating the character generators to display new lines of information as a function of the mirror position.

11. The display system of claim 5 further including means for changing the information presented by periodically activating the character generators to shift the characters in a line of information, deleting the first character and adding a new last character, as a function of the mirror position.

12. A display system for presenting information to be viewed at multiple viewing stations, comprising:

a housing having openings to form the viewing stations;

character generator means mounted within the housing;

a mirror mounted within the housing;

means for rotating the mirror about an axis to provide a reflective light path from the character generator means to the openings;

means for determining the position of the mirror; and means for preventing viewers at other viewing stations from observing the information presented at a viewing station, including means responsive to the position of the mirror for activating the character generator at predetermined positions of the mirror which provide a reflective light path from the character generator means to the opening at a desired one of the viewing stations, and further including keyboards at each of the viewing stations, the keyboards being mounted in a recess formed underneath the respective openings so that ambient light rays reflected from the keyboards do not enter the openings and are absorbed by the housing.

* * * * *